US005735381A

United States Patent [19]

Brizzi et al.

[11] Patent Number: 5,735,381

[45] Date of Patent: Apr. 7, 1998

[54] HALF-PACKET STEP CONVEYOR FOR PRODUCING TWIN PACKETS OF CIGARETTES

[75] Inventors: Marco Brizzi, Zola Predosa; Antonio Gamberini, Bologna, both of Italy

[73] Assignee: G.D Societa' Per Azioni, Bologna, Italy

[21] Appl. No.: 375,524

[22] Filed: Jan. 19, 1995

[30] Foreign Application Priority Data

Jan. 20, 1994 [IT] Italy ..... BO94A0011

[51] Int. Cl.[6] ..... B65G 47/04

[52] U.S. Cl. ..... 198/370.07

[58] Field of Search ..... 198/358, 370.07

[56] References Cited

U.S. PATENT DOCUMENTS

| | | | |
|---|---|---|---|
| 1,476,737 | 12/1923 | Strout | 198/370.07 X |
| 3,040,862 | 6/1962 | Schmermund et al. | 198/358 X |
| 3,450,258 | 6/1969 | Poupin | 198/370.07 X |
| 4,238,025 | 12/1980 | Manservisi | 198/358 X |
| 4,243,135 | 1/1981 | Heitmann | 198/370.07 |
| 4,792,033 | 12/1988 | Iwata et al. | 198/358 X |
| 4,830,171 | 5/1989 | Kupper | 198/358 X |
| 4,949,833 | 8/1990 | Sakamoto et al. | 198/358 |

FOREIGN PATENT DOCUMENTS

| | | |
|---|---|---|
| 1196821 | 1/1970 | United Kingdom . |
| 1193860 | 3/1970 | United Kingdom . |

*Primary Examiner*—James W. Keenan

*Attorney, Agent, or Firm*—Marshall, O'Toole, Gerstein, Murray & Borun

[57] ABSTRACT

A conveyor for step-feeding half packets along a wrapping line for producing twin packets of cigarettes consisting of two half packets with respective foil wrappings and arranged side by side inside an outer wrapping; the half packets being fed through a restoring station and being engaged by a restoring device which, when operated, provides for selectively shifting a half packet from a first location to a second location in the succession of half packets along the conveyor.

8 Claims, 2 Drawing Sheets

HALF-PACKET STEP CONVEYOR FOR PRODUCING TWIN PACKETS OF CIGARETTES

BACKGROUND OF THE INVENTION

The present invention relates to a half-packet step conveyor for producing twin packets of cigarettes.

Here and hereinafter, the term "twin packet" is intended to mean a packet consisting of two half packets with respective foil wrappings and arranged side by side inside the same outer wrapping.

Currently marketed machines for producing twin packets normally comprise a step conveyor defining the output portion of two first side by side wrapping lines for simultaneously forming two successions of groups of cigarettes, and forming a foil wrapping about each group to produce a respective half packet. In other words, the conveyor is so designed as to feed a succession of pairs of half packets to a transfer station from which they are then transferred to a second wrapping line along which an outer wrapping is formed about each pair.

In addition to being expensive and relatively complex in terms of design and maintenance, a two-line conveyor of the aforementioned type also fails to provide for efficient throughput of the half packets in each pair in the event either one is rejected due to a defect involving the cigarettes or the wrapping. In fact, using said two first side by side wrapping lines, when a half packet on one line is rejected, the corresponding half packet on the other line is also rejected to prevent the formation of an incomplete pair.

SUMMARY OF THE INVENTION

It is an object of the present invention to provide a half-packet step conveyor for producing twin packets and designed to overcome the aforementioned drawbacks.

According to the present invention, there is provided a half-packet step conveyor for producing twin packets, the conveyor comprising a number of pockets for receiving respective half packets and arranged successively along a path for feeding the half packets in one succession in a given traveling direction; characterized in that it also comprises a restoring device located along said path and in turn comprising transfer means movable in relation to said pockets, for selectively moving a half packet from a first pocket to a free second pocket upstream from the first in said traveling direction.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
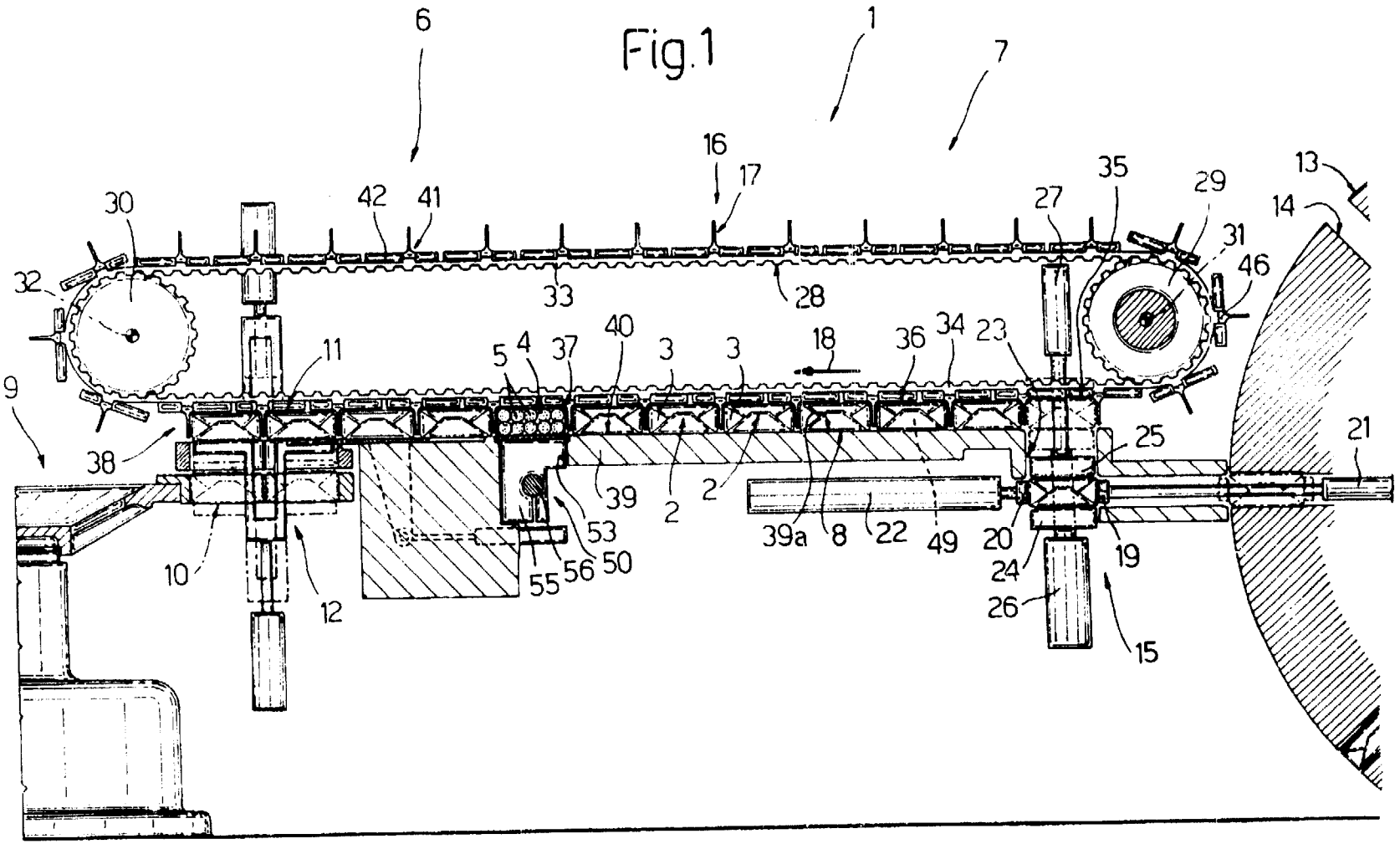
FIG. 1 shows a side view, with parts in section and parts removed for clarity, of a preferred embodiment of the conveyor according to the present invention.

Number 1 in FIG. 1 indicates a packing machine for producing twin packets (not shown), i.e. packets comprising two half packets 2, each comprising a foil wrapping 3 enclosing a group 4 of ten cigarettes 5 in two superimposed layers.

Machine 1 comprises a single wrapping line 6 in turn comprising an input portion 7 for forming a single succession 8 of half packets 2; an output portion 9 (shown only partially) for forming a succession of twin packets (not shown) from a single succession 10 of groups or pairs 11 of side by side half packets 2; and a pairing unit 12 interposed between input portion 7 and output portion 9, for successively forming pairs 11 by pairing half packets 2 from input portion 7 and feeding pairs 11 successively to output portion 9.

With reference to FIG. 1, input portion 7 of line 6 is substantially the same as that of a normal packet wrapping line (not shown), and comprises, among other things, a known folding wheel 13 presenting a number of peripheral pockets 14 and rotating about a substantially horizontal axis (not shown) perpendicular to the FIG. 1 plane. Each pocket 14 houses, in known manner, a respective group 4 and a respective portion of foil (not shown); and wheel 13 presents, in known manner, known folding devices (not shown) for folding each said portion of foil (not shown) about a respective group 4 to form a respective wrapping 3 and a respective finished half packet 2. Each portion of foil is folded in known manner as the respective group 4 is fed to a transfer device 15 which successively transfers half packets 2 from wheel 13 to a conveyor 16 presenting a succession of pockets 17 for receiving respective half packets 2. Conveyor 16 forms the output of input portion 7 of wrapping line 6, and extends in a substantially horizontal direction 18 perpendicular to the axis (not shown) of wheel 13.

As shown clearly in FIG. 1, device 15 comprises a known push device 19 and a known counterpush device 20 movable back and forth in known manner, by respective actuators 21 and 22, in a direction parallel to direction 18, for successively transferring half packets 2 from respective pockets 14 on wheel 13 into a feed channel 23 perpendicular to direction 18. Device 15 also comprises a further known push device 24 and a further known counterpush device 25 movable back and forth in known manner, by respective actuators 26 and 27, along at least part of channel 23, for successively transferring half packets 2 into respective pockets 17 on conveyor 16.

Figure 2:
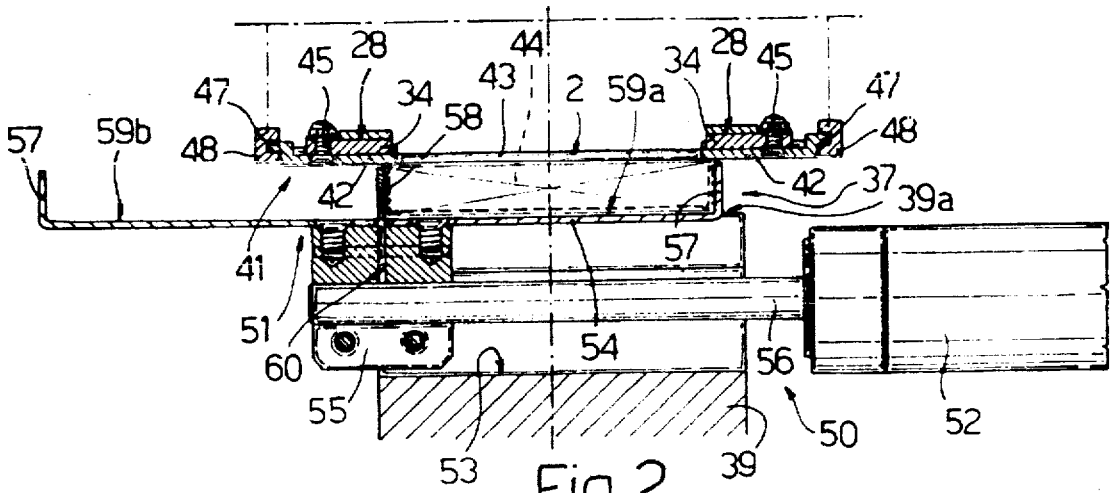
FIGS. 2 and 3 show larger-scale side views of a detail in FIG. 1 in two different operating positions.

With reference to FIG. 2, conveyor 16 comprises two internally toothed belts 28, each looped about two pulleys 29 and 30, one of which is powered. Pulleys 29 and 30 are mounted for rotation about respective substantially horizontal axes 31 and 32 parallel to each other and to the axis (not shown) of wheel 13, and are respectively located adjacent to transfer device 15 and pairing unit 12. On each belt 28, pulleys 29 and 30 define a top return branch 33, and a bottom transportation branch 34 which is fed in steps in direction 18 through a loading station 35 located at transfer device 15 and at the top end of channel 23, a reject station 36, a restoring station 37, and an unloading station 38 located at pairing unit 12. Bottom branches 34 of belts 28 are arranged facing and parallel to a supporting and slide-along plate 39 extending parallel to direction 18 between loading and unloading stations 35 and 38, and defining, with bottom branches 34, a channel 40 along which to feed half packets 2.

Figure 3:
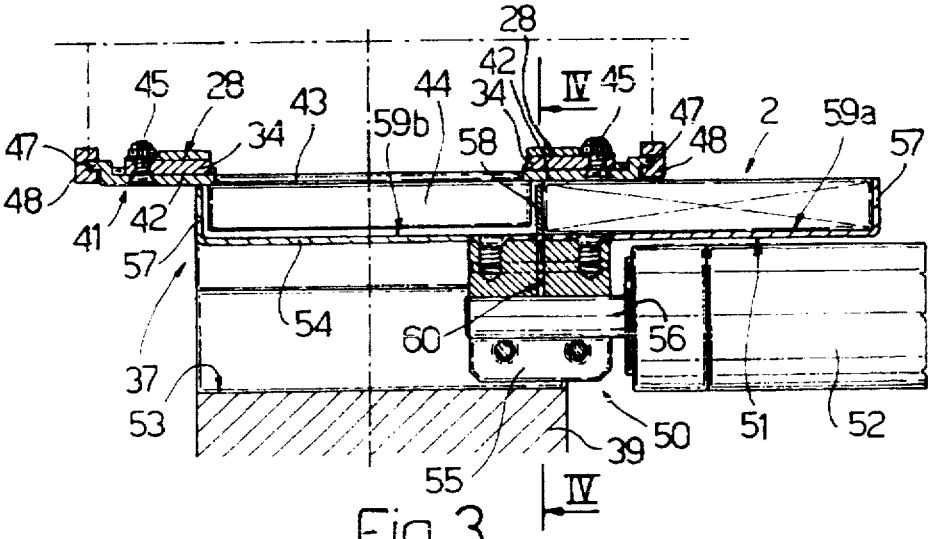

As shown clearly in FIGS. 2 and 3, belts 28 are made integral with each other by means of a succession of crosswise tracks 41, each of which, when viewed from above, is substantially H-shaped, and comprises two side members 42 extending along respective belts 28 and connected to each other by a central cross member 43 fitted integral with the inner lateral edge of a wall 44. Wall 44 is perpendicular to belts 28, is substantially rectangular, and presents a width substantially equal to the distance between belts 28, and a height approximately equal to but no more than the thickness of a half packet 2 and the height of channel 40. Each side member 42 is connected to respective belt 28 by a central screw 45 substantially located at wall 44 and defining, with screw 45 of the other side member 42, a virtual hinge 46 about which respective track 41 rotates in relation to belts 28. Each side member 42 presents a longitudinal outer rib 47 which engages a respective guide 48 extending between stations 35 and 38 and parallel to plate 39, for maintaining branches 34 of belts 28 and respective tracks 41 perfectly parallel to plate 39. When the relative tracks 41 are aligned, walls 44 of each pair of adjacent tracks 41 define a respective pocket 17 for feeding a respective half packet 2 in direction 18 and along channel 40.

As shown in FIG. 1, at reject station 36, conveyor 16 cooperates with a known push device 49 which, operating through channel 40 and crosswise to direction 18, provides for expelling a half packet 2 from a stationary pocket 17 in station 36 following a reject signal emitted in known manner by a known control unit (not shown).

As shown in FIGS. 2 and 3, at restoring station 37 downstream from reject station 36 in direction 18, conveyor 16 cooperates with a restoring device 50 comprising a box 51 which is moved through channel 40 and crosswise to direction 18 by an actuating device 52 controlled by said control unit (not shown), for removing a half packet 2 from a stationary pocket 17 in station 37, or for feeding a half packet 2 into a stationary empty pocket 17 in station 37.

Box 51 is mounted in sliding manner inside an opening 53 formed crosswise to direction 18 through plate 39, and comprises a bottom plate 54 located beneath and substantially contacting the free end of walls 44 of tracks 41 on bottom branches 34 of belts 28, and which underneath presents a bracket 55 extending downwards inside opening 53 and connected to the free end of the output rod 56 of actuating device 52. Plate 54 is substantially rectangular with a width, measured parallel to direction 18, substantially equal to the width of a half packet 2, and presents, at its opposite longitudinal ends, two walls 57 perpendicular to walls 44 of tracks 41 on bottom branches 34 of belts 28 and extending upwards from plate 54 to substantially contact tracks 41.

Walls 57 define, on the topside of plate 54, a trough divided by a central partition 58 into two compartments **59*a* and 59*b*, each for receiving a respective half packet 2 with its longer longitudinal axis perpendicular to direction 18, and with its larger lateral surface contacting plate 54**.

Figure 4:
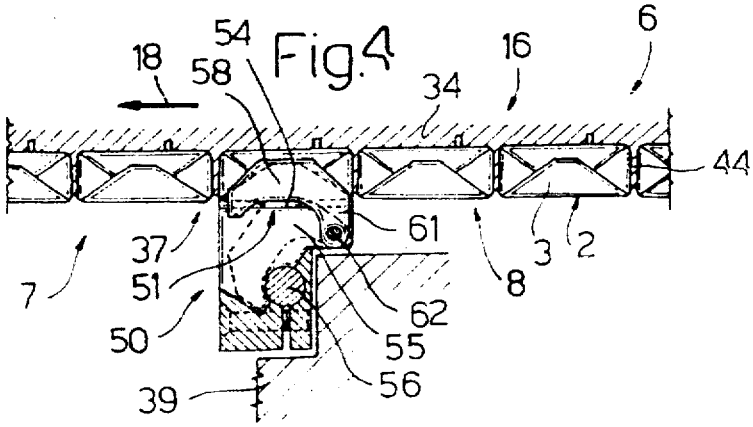
FIG. 4 shows a section along line IV—IV in FIG. 3.

As shown in FIG. 4, partition 58 is collapsible, is fitted through an opening 60 in plate 54, and presents, on the end upstream in direction 18, an appendix 61 extending beneath plate 54 and mounted for rotation on a pin 62 fitted horizontally to bracket 55 and crosswise to direction 18 and about which partition 58 is rotated, in opposition to a spring (not shown), from a raised position above plate 54, to a bottom limit position beneath plate 54 and contacting rod 56 of actuating device 52.

In actual use, half packets 2, formed in known manner (in exactly the same way as for normal packets) as they are fed forward on wheel 13, are transferred by device 15 into respective pockets 17 on conveyor 16, and define a single succession 8 about wheel 13 and along conveyor 16.

Each half packet 2 is then slid in steps along the top surface **39*a* of plate 39 to reject station 36 where, in the event a defect has been detected beforehand in the manufacture and/or filling of cigarettes 5 and/or in the formation of wrapping 3, it is engaged by push device 49 and expelled from pocket 17**.

If passed, half packet 2 is fed in steps through an empty compartment 59 of box 51 maintained stationary at restoring station 37 and aligned with conveyor 16, and is fed by conveyor 16 in steps to unloading station 38.

Now let us consider the reverse situation wherein half packet 2 is rejected in station 36 so that an empty pocket 17 is fed towards station 38, and bearing in mind that each half packet 2 traveling along conveyor 16 is to be considered as forming a pair 11 with the adjacent half packet 2.

In the event either one of half packets 2 in pair 11 is rejected, the other half packet 2 in the incomplete pair should also, at least theoretically, be rejected. This is avoided, however, by device 50 which operates selectively in two distinct modes depending on whether or not one of compartments 59 is engaged by a half packet 2. As restoring device 50 always operates first in one mode and then in the other, both modes will be described one after the other as of the condition wherein both compartments 59 are empty.

In the event both compartments 59 are empty and one of them, e.g. compartment **59*a* (FIG. 2), is located along the path of walls 44 of tracks 41, when the half packet 2 corresponding to the rejected one is arrested inside compartment 59*a*, box 51 is shifted by actuator device 52 so as to remove the half packet 2 in compartment 59*a* from channel 40 and align compartment 59*b* (FIG. 3) with the path of walls 44 of tracks 41. This therefore results in the formation of a further empty pocket 17 next to the one vacated in reject station 36, and in the formation of a gap in succession 10, which is compensated by machine 1 in known manner by a one-step suspension in the supply of wrapping material (not shown) to output portion 9 of line 6**.

The half packet 2 inside compartment **59*a* is "parked" alongside succession 8 until a further pocket 17 is vacated at the reject station and arrested inside the empty compartment 59*b* at restoring station 37; at which point, actuator 52 is operated to shift box 51 back to its original position, i.e. wherein compartment 59*a* is aligned with tracks 41, and so feed the "parked" half packet 2 back into succession 8 inside the pocket 17 vacated at reject station 36**.

By transferring a half packet 2 from a first pocket 17 to a second pocket 17 upstream in direction 18, box 51 thus provides for preventing incomplete pairs 11 from being supplied to output portion 9 of wrapping line 6, as well as for preventing the rejection of half packets 2 with no defects.

As regards collapsible partition 58, it should be pointed out that all the movable parts associated with conveyor 16 are rigidly timed and controlled mechanically by a machine shaft (not shown), with the exception of reject push device 49 and restoring device 50, which, as stated, are controlled electronically by said control unit (not shown). As the possibility, however, of pockets 17 and box 51 falling out of step cannot be altogether excluded, box 51 is provided with a collapsible partition 58 to prevent any off-timing resulting in irreparable damage to walls 44 of tracks 41.

The fact that machine 1 as described above comprises a wrapping line 6 with an input portion 7 along which half packets 2 are fed in a single succession 8 undoubtedly involves disadvantages in terms of the high operating speed of portion 7, which must be operated at twice the speed of output portion 9. This is amply compensated for, however, by the fact that, with the exception of a change in format, portion 7 is substantially identical to the input portion of a standard packet wrapping line and as such is relatively economical and highly reliable. Moreover, the fact that half packets 2 are fed in a single succession 8 along portion 7 not only provides for minimizing servicing time and expense, but also enables the use of restoring device 50, which would be substantially impossible in the event two parallel successions 8 of half packets 2 were to be fed along input portion 7 of line 6.

We claim:

1. A half-packet step conveyor for producing twin packets each containing two half-packets, the conveyor comprising a number of pairs of pockets arranged successively along a path, each pair of pockets being adapted to receive the two half-packets of a respective twin packet; drive means for advancing the conveyor in a stepped manner and in a given traveling direction; and a restoring device located along said path and comprising transfer means movable in relation to said pockets, for selectively moving a half packet from a first pocket of a first pair of pockets to a free second pocket of a second pair of pockets upstream from the first pair of pockets in said traveling direction, wherein said transfer means comprise a box movable across said path and in a direction crosswise to said traveling direction, the box comprising two compartments aligned in said crosswise direction and each for receiving a half packet; and actuating means connected to the box and for selectively aligning said two compartments with said path.

2. A conveyor as claimed in claim 1, wherein said box comprises a collapsible partition parallel to said traveling direction.

3. A half-packet step conveyor for producing twin packets each containing two half-packets, the conveyor comprising a number of pairs of pockets arranged successively along a path, each pair of pockets being adapted to receive the two half-packets of a respective twin packet; drive means for advancing the conveyor in a stepped manner and in a given traveling direction; and a restoring device located along said path and comprising transfer means movable in relation to said pockets, for selectively moving a half packet from a first pocket of a first pair of pockets to a free second pocket of a second pair of pockets upstream from the first pair of pockets in said traveling direction, a reject device along said path and upstream from said transfer means in said travelling direction, wherein said transfer means comprise a box movable across said path and in a direction crosswise to said traveling direction, the box comprising two compartments aligned in said crosswise direction and each for receiving a half packet; and actuating means connected to the box and for selectively aligning said two compartments with said path.

4. A half-packet step conveyor for producing twin packets each containing two half-packets, the conveyor comprising a number of pairs of pockets arranged successively along a path, each pair of pockets being adapted to receive the two half-packets of a respective twin packet; drive means for advancing the conveyor in a stepped manner and in a given traveling direction; and a restoring device arranged at a fixed location along said path and comprising transfer means adapted to reciprocate in relation to said pockets and in a direction crosswise to said path, for selectively moving a half packet from a pocket of a first pair of pockets to a free pocket of a second pair of pockets upstream from the first pair of pockets in said traveling direction.

5. A conveyor as claimed in claim 4, wherein the pocket of said second pair of pockets adjacent to said free pocket receives, in use, a half-packet.

6. A conveyor as claimed in claim 4, wherein said transfer means comprise a box comprising two compartments aligned in said crosswise direction and each for receiving a half packet; and actuating means connected to the box for reciprocating the box across said path to selectively align said two compartments with said path.

7. A conveyor as claimed in claim 6, wherein said box comprises a collapsible partition parallel to said travelling direction.

8. A conveyor as claimed in claim 4, further comprising a reject device along said path and upstream from said transfer means in said travelling direction.

* * * * *